US012098664B2

(12) United States Patent
Bardakjy

(10) Patent No.: US 12,098,664 B2
(45) Date of Patent: Sep. 24, 2024

(54) MECHANICALLY TIMED CYLINDER DEACTIVATION SYSTEM

(71) Applicant: Cummins Inc., Columbus, IN (US)

(72) Inventor: Scott Robert Bardakjy, Columbus, IN (US)

(73) Assignee: Cummins Inc., Columbus, IN (US)

( * ) Notice: Subject to any disclaimer, the term of this patent is extended or adjusted under 35 U.S.C. 154(b) by 190 days.

(21) Appl. No.: 17/651,945

(22) Filed: Feb. 22, 2022

(65) Prior Publication Data

US 2022/0178280 A1 Jun. 9, 2022

Related U.S. Application Data

(63) Continuation of application No. PCT/US2020/049827, filed on Sep. 9, 2020.

(60) Provisional application No. 62/903,042, filed on Sep. 20, 2019.

(51) Int. Cl.

| | |
|---|---|
| ***F01L 13/00*** | (2006.01) |
| ***F01L 1/047*** | (2006.01) |
| ***F01L 1/14*** | (2006.01) |

(52) U.S. Cl.

CPC ..... *F01L 13/0005* (2013.01); *F01L 1/047* (2013.01); *F01L 1/14* (2013.01); *F01L 2013/001* (2013.01); *F01L 2250/06* (2013.01)

(58) Field of Classification Search

CPC ..... F01L 1/047; F01L 2001/0475; F01L 13/0005; F01L 2013/001

See application file for complete search history.

(56) References Cited

U.S. PATENT DOCUMENTS

| | | | |
|---|---|---|---|
| 5,158,049 | A | 10/1992 | Neumann |
| 5,501,121 | A | 3/1996 | Beier et al. |
| 6,588,394 | B2 | 7/2003 | Zheng |
| 7,040,277 | B2 | 5/2006 | Hasebe et al. |
| 7,263,956 | B2 | 9/2007 | Spath et al. |
| 9,217,339 | B2 | 12/2015 | McConville et al. |
| 9,297,282 | B2 | 3/2016 | Byrd et al. |
| 2010/0175645 | A1 | 7/2010 | Berger |
| 2017/0248073 | A1 | 8/2017 | McCarthy |
| 2017/0356314 | A1 | 12/2017 | McConville |

FOREIGN PATENT DOCUMENTS

| | | | | |
|---|---|---|---|---|
| CA | 2367555 | C * | 3/2006 | ..... F01L 1/146 |
| CN | 101835958 | B * | 8/2012 | ..... F01L 1/3442 |
| CN | 104603404 | A | 5/2015 | |
| CN | 106246277 | A | 12/2016 | |
| CN | 107489542 | A | 12/2017 | |
| CN | 109083707 | A | 12/2018 | |

(Continued)

OTHER PUBLICATIONS

Chinese Office Action, Chinese Appln. No. 202080065589.7, 6 pgs., dated Aug. 8, 2023.

(Continued)

*Primary Examiner* — Ngoc T Nguyen

(74) *Attorney, Agent, or Firm* — Taft Stettinius & Hollister LLP

(57) ABSTRACT

A system and method for mechanically timed cylinder deactivation includes an inner passage in the camshaft that supplies fluid for deactivating one or more valve opening mechanisms associated with the cylinders of an internal combustion engine.

16 Claims, 6 Drawing Sheets

(56) References Cited

FOREIGN PATENT DOCUMENTS

| | | | | | |
|---|---|---|---|---|---|
| DE | 3920938 | A1 | | 1/1990 | |
| DE | 4100763 | A1 | | 7/1992 | |
| DE | 4207494 | A1 | | 9/1993 | |
| JP | 2001329873 | A | | 11/2001 | |
| KR | 20040097415 | A | | 11/2004 | |
| WO | WO-2015187469 | A1 | * | 12/2015 | ..... F01L 1/344 |
| WO | WO-2021055191 | A1 | * | 3/2021 | ..... F01L 1/047 |

OTHER PUBLICATIONS

Extended European Search Report, EP Appln. No. 20866067.0, Oct. 4, 2023, 8 pgs.
International Search Report and Written Opinion, PCT Appln. No. PCT/US20/49827, Dated Nov. 30, 2020, 8 pgs.
Office Action, National Intellectual Property Administration, PRC, Chinese Patent Application. No. 202080065589.7, Mar. 29, 2024, 7 pages.

* cited by examiner

MECHANICALLY TIMED CYLINDER DEACTIVATION SYSTEM

CROSS-REFERENCE TO RELATED APPLICATIONS

The present application is a continuation of International Patent Application No. PCT/US20/49827, filed Sep. 9, 2020 which claims the benefit of the filing date of U.S. Provisional Application Ser. No. 62/903,042 filed on Sep. 20, 2019, which are incorporated herein by reference in their entirety.

FIELD OF THE INVENTION

This disclosure relates generally to internal combustion engine operation, and more particularly to systems and methods for dynamic cylinder deactivation with a mechanically timed cylinder deactivation system.

BACKGROUND

The cylinders in an internal combustion engine can be deactivated in order to reduce fuel consumption and/or to provide thermal management of the engine and/or aftertreatment components. This may be accomplished by cutting off the supply of fuel to selected cylinders, particularly to save fuel under light engine load conditions. Cylinder deactivation can also include disabling or maintaining the intake and/or exhaust valves of the cylinder(s) in a closed condition during the cylinder deactivation event.

Prior art solutions to provide cylinder deactivation involve a number of approaches. For example, one approach deactivates the same cylinders of the engine upon command. Therefore, a single solenoid can control the deactivation of a set number of cylinders out of the total number of cylinders of the engine; however, the set number of cylinders are the only cylinders that are ever deactivated, and those set number of cylinders are all deactivated at the same time. This can create noise, vibration, and harshness (NVH) issues and provides no flexibility for the CDA mode of operation.

Another approach is that a multitude of solenoids are used that each control deactivation of a subset of one or more cylinders (such as one solenoid per cylinder). This arrangement allows a rolling or dynamic deactivation which allows different ones of the cylinders to be selected for deactivation depending on the solenoid that is selected for operation. The solenoid selection process, and thus the selection of cylinders for deactivation, could be employed in a way to improve NVH of the engine. For example, different ones of the cylinders may be deactivated to improve NVH rather than having a fixed selection of cylinders for deactivation as outlined in the first approach. However, this latter approach requires a complex oil system and multiple solenoids to provide rolling deactivation among the cylinders. In addition, electronic components present durability concerns, so providing multiple solenoids is not desirable. Therefore, additional improvements in cylinder deactivation are needed.

SUMMARY

Systems, methods, and apparatus for controlling dynamic cylinder deactivation using mechanical timing for a multi-cylinder internal combustion engine are disclosed.

The system, apparatus, and/or methods are employed with an internal combustion engine including a plurality of cylinders and valve opening mechanisms for opening and closing intake and/or exhaust valves of each of the plurality of cylinders. At least one of the valve opening mechanisms is configured to be deactivated so that at least one of the intake and/or exhaust valves remains closed during the cylinder deactivation event.

In certain embodiments, the camshaft includes an inner passage that supplies pressurizable fluid for actuating the cylinder deactivation system of one or more valve opening mechanisms associated with one or more cylinders to be deactivated. In certain embodiments, the inner passage is located in the camshaft. In other embodiments, the inner passage is provided by an inner shaft that is housed in the camshaft. In either embodiment, one or more fluid flow paths are provided from the inner passage to the one or more cylinder deactivation systems that are mechanically timed to align the fluid supply to the one or more cylinder deactivation system during the cylinder deactivation event to deactivate the one or more valve opening mechanisms of the cylinders to be deactivated. The pressurization of the fluid in the inner passage can be controlled by a single solenoid in the flow path between the fluid source and the inner passage that is activated in response to the cylinder deactivation event being initiated based on one or more operating conditions of the engine, such as low load, idle conditions, etc.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION

Figure 1:
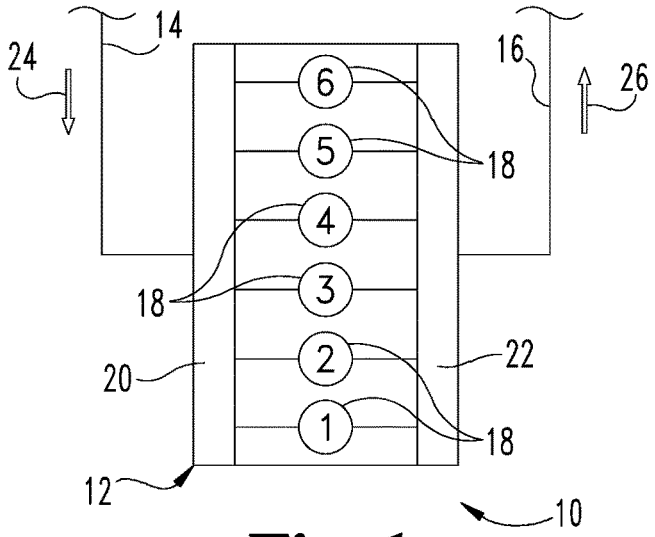
FIG. 1 is a schematic of one embodiment of an internal combustion engine system with a plurality of cylinders.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 shows an internal combustion engine system 10 according to one embodiment of the present application.

System 10 includes an internal combustion engine 12 having an intake system 14 and an exhaust system 16. Engine 12 can be any type of engine, and includes a number of cylinders 18 each housing a piston. Cylinders 18 receive an intake flow 24 and combust a fuel provided thereto to produce an exhaust flow 26 from each of the cylinders. In the illustrated embodiment, engine 12 includes six cylinders connected with an intake manifold 20 and an exhaust manifold 22. Engine 12 can be an in-line type engine with a single cylinder bank, although other embodiments include V-shaped cylinder arrangements, a W-type engine, or any engine arrangement with one or more cylinders. It is contemplated that engine 12 is provided as part of a powertrain for a vehicle (not shown).

Figure 2:
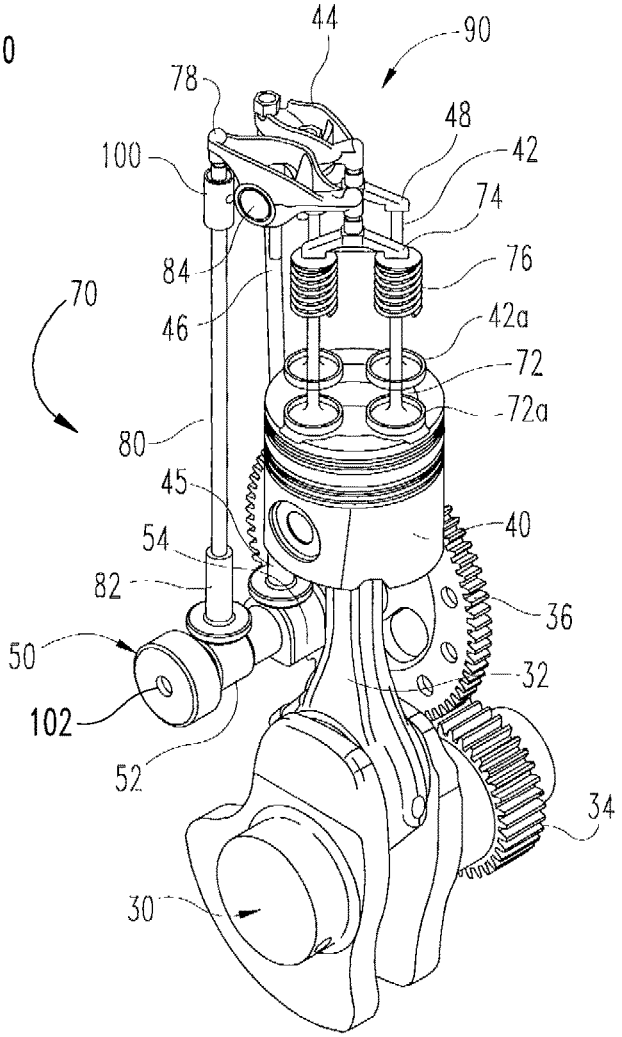
FIG. 2 is a perspective view of a portion of the internal combustion engine of FIG. 1 including a valve opening mechanism and cylinder deactivation system for one of the plurality of cylinders.

Referring to FIG. 2, there is illustrated one embodiment of a portion of engine 12 including crankshaft 30, a piston 40, a camshaft 50, and a valve opening mechanism 90 that includes a hydraulically activated cylinder deactivation (CDA) system 70. It should be understood that any suitable arrangement for opening and closing intake and exhaust valves and for deactivating one or more of the intake and exhaust valves is contemplated herein, and the arrangement in FIG. 2 is provided as an example for discussion purposes only.

Piston 40 is housed in a respective one of the cylinders 18, and is rotatably connected to crankshaft 30 with a connecting rod 32 so that reciprocating movement of piston 40 rotates crankshaft 30, as known in the art. Crankshaft 30 may also include a first gear 34, and first gear 34 is connected to a second gear 36 that is connected to camshaft 50. Rotation of crankshaft 30 rotates camshaft 50 at, for example, half speed of crankshaft 30 with gears 34, 36 providing a gear or drive reduction, as known in the art. Other embodiments contemplate other types of drive connections between crankshaft 30 and camshaft 50, such as a chain or belt drive or planetary gear set.

Each cylinder 18 of engine 12 houses a piston 40 that is connected to crankshaft 30 and camshaft 50. Each cylinder 18 also includes at least one intake valve 42 that is opened and closed by a corresponding valve opening mechanism 90 connected to a respective intake cam lobe 54 of camshaft 50. The opening of the intake valve(s) 42 allow a charge flow to be admitted into the combustion chamber of the respective cylinder 18 through an intake opening 42*a*. In the illustrated embodiment, the intake valve 42 includes first and second intake valves connected by an intake cross head 48 of intake rocker 44. Intake cross head 48 is connected to an intake rocker 44, which is rotatable about a rocker axis in response to an intake valve opening lobe of intake cam 54 pushing on the intake push rod 46 as the intake valve opening lobe of intake cam 54 passes against intake cam follower 45 at the end of push rod 46.

Each cylinder 18 further includes at least one exhaust valve 72. Opening of the at least one exhaust valve 72 with valve opening mechanism 90 allows exhaust gases created by combustion of the charge flow to escape the combustion chamber of the respective cylinder 18 through an exhaust opening 72*a*. In the illustrated embodiment, the exhaust valve 72 includes first and second exhaust valves connected by an exhaust cross head 74. Each exhaust valve(s) 72 further includes an exhaust valve spring(s) 76 actuated by an exhaust rocker 78 through exhaust cross head 74 (if provided) to open and close the exhaust valve(s) 72 in response to an exhaust valve opening lobe on exhaust cam 52 acting on exhaust push rod 80.

The CDA system 70 operates via pressurized fluid supplied from an inner passage 102 of camshaft 50 to unlock a collapsible element during a CDA mode of operation. In one embodiment, the collapsible element is a cam follower tappet, exhaust rocker or push rod connector of one of the exhaust valves and/or intake valves. For example, for an exhaust valve type of CDA system 70, the collapsible element is configured so that the hydraulic fluid pressure allows the collapsible element, such as a cam follower tappet 82, exhaust rocker 78, and/or push rod connector 100, to collapse in response to the exhaust cam lobe acting on push rod 80. As a result, the exhaust valve(s) 72 are not lifted from their respective valve seats and provide cylinder deactivation using exhaust valve(s) 72 when a CDA mode of operation is activated, as discussed further below. Other embodiments contemplate a CDA system 70 can be provided additionally or alternatively on the at least one intake valve 42. CDA system 70 is just one example of a CDA system contemplated herein, and any CDA system that employs fluid pressure from an inner passage 102 of camshaft 50 for activation and/or deactivation is contemplated herein.

In the illustrated embodiment, push rod connector 100 is connected to an exhaust push rod 80 that extends through a bore in a block of engine 12 and/or the cylinder head, and is engaged to exhaust cam 52 with cam follower tappet 82. Cam follower tappet 82 is engaged to an end of exhaust push rod 80. Exhaust push rod 80 translates in response to rotation of one or more lobes of exhaust cam 52 acting on cam follower tappet 82 and acts through push rod connector 100 to pivot exhaust rocker 78 about a rocker shaft 84. During a CDA mode of operation, the collapsible element of CDA system 70 is configured to collapse so that the exhaust cam lobe profile is not transferred to lift the exhaust valve(s) 72, thus deactivating the respective cylinder 18 to which the exhaust valve(s) 72 are mounted.

Figure 3:
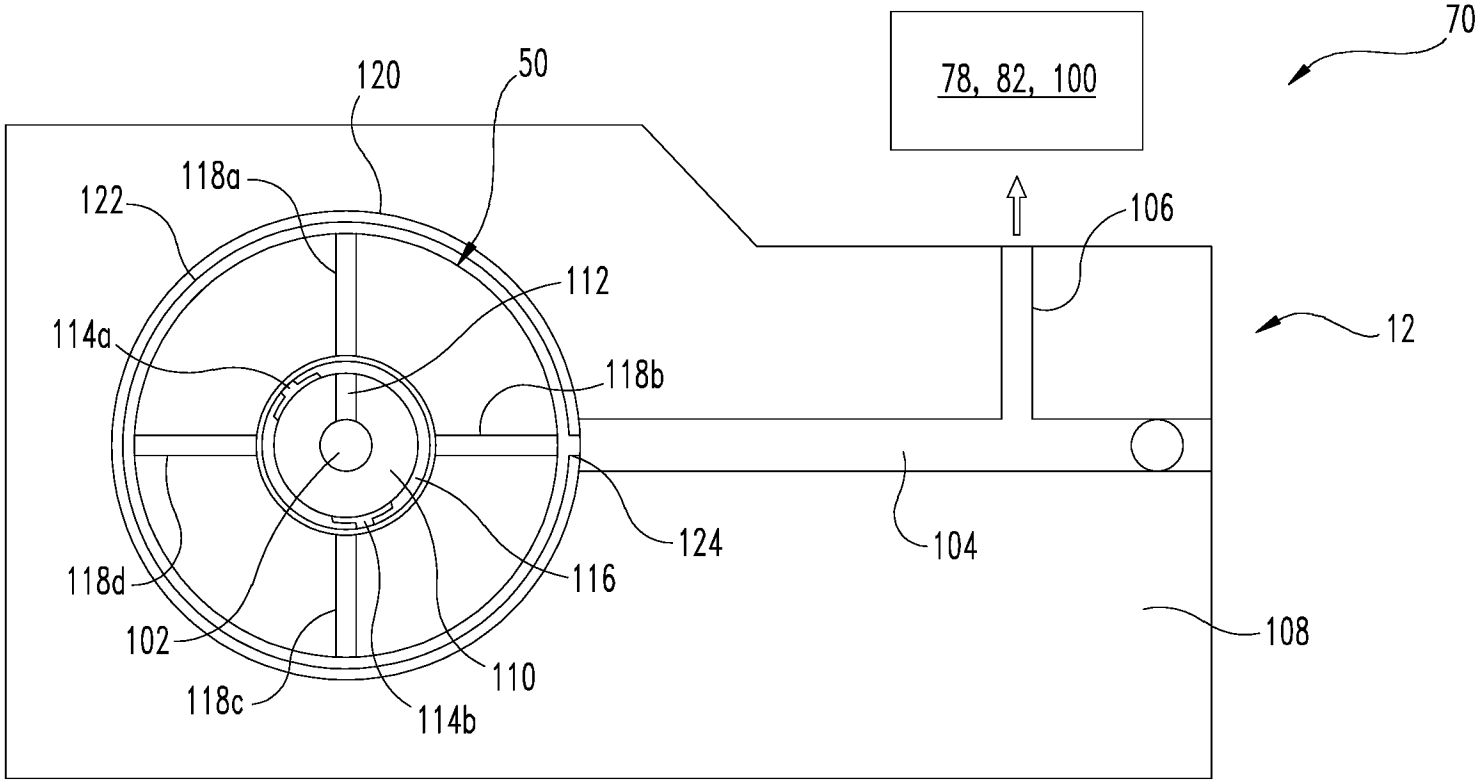
FIG. 3 is a cross-section of one embodiment of a camshaft including a cylinder deactivation system.

Referring to FIG. 3, one embodiment of CDA system 70 is shown in which inner passage 102 of camshaft 50 is in fluid communication with the collapsible element 78, 82, 100 through one or more fluid passages 104, 106 in engine 12. Passages 104, 106 can be formed in the block and/or cylinder head 108 depending on the type of camshaft arrangement that is employed.

In FIG. 3, inner passage 102 is provided in an inner shaft 110 that is located within and rotatable relative to camshaft 50. Inner shaft 110 includes a radially extending feed path 112 extending from the inner passage 102 to feed fluid from the inner passage 102 to one or more through slots 114*a*, 114*b* of an inner bushing 116. Inner bushing 116 is located around inner shaft 110 and between inner shaft 110 and the camshaft 50. The one or more through slots 114*a*, 114*b* of the inner bushing 116 communicate with one or more radially extending transfer holes 118*a*, 118*b*, 118*c*, 118*d* in the camshaft 50 to provide the fluid from the inner passage 102 to an annular groove 122 around the inner circumference of the outer bushing 120. Groove 122 is in fluid communication with the one or more transfer holes 118*a*, 118*b*, 118*c*, 118*d* and an outlet 124 of outer bushing 120 aligned with passage 104. Fluid from inner passage 102 can therefore be supplied to a rifling connected to collapsible element 78, 82, 100 of the CDA system 70 associated with one or more of the plurality of valve opening mechanisms 90 of one or more of cylinder(s) 18 that are to be deactivated.

In the illustrated embodiment of FIG. 3, two through slots 114*a*, 114*b* are spaced from one another around the inner bushing 116 at a predetermined interval and with a predetermined arc length around the inner circumferential surface of the inner bushing 116 to collect fluid from inner passage 102 at certain crank angle windows of crankshaft 30. When one of the through slots 114*a*, 114*b* is aligned with the feed path 112 during a CDA mode of operation, pressurized fluid is supplied to the CDA system(s) 70 that are connected to the fluid passages 104, 106. As a result, the deactivation schedule for cylinders 118 is fixed into the hardware of the camshaft 50 and is timed by the connection with the crankshaft 30. In one embodiment, a first one of the through slots 114*a*, 114*b* is associated with the CDA system 70 and/or valve opening mechanisms 90 for a first pair of the plurality of cylinders 18 for selectively deactivating the first pair of the plurality of cylinders 18 in response to the first through slot 114*a* aligning with the feed path 112. A second one of the through slots 114*a*, 114*b* is associated with CDA system 70 and/or valve opening mechanisms 90 for a second pair of the plurality of cylinders 18 in response to the second through slot 114*b* aligning with the feed path 112.

Figure 4:
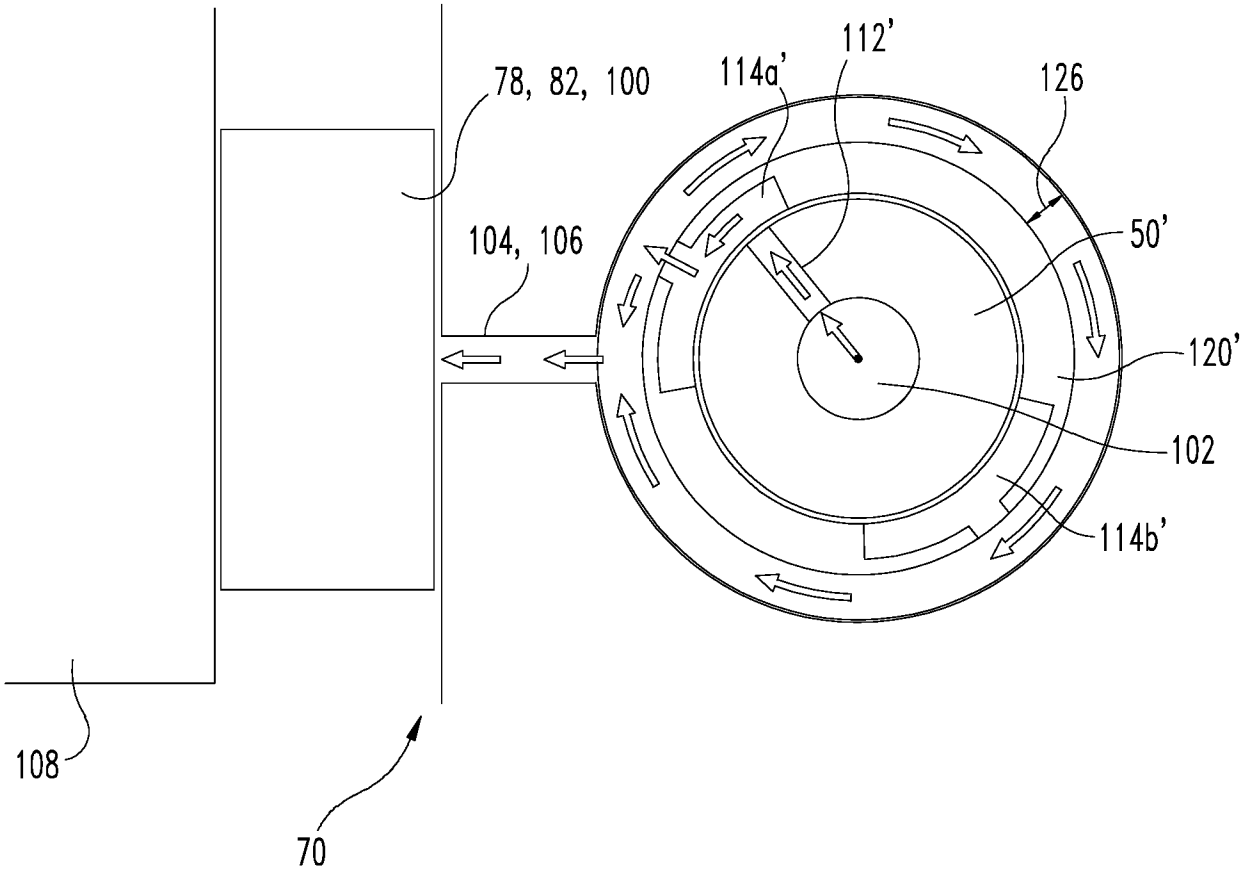
FIG. 4 is a cross-section of another embodiment of a camshaft including a cylinder deactivation system.

Referring to FIG. 4, another embodiment of camshaft 50 is shown and designated as camshaft 50'. Camshaft 50' is similar to camshaft 50, but defines the inner passage 102 directly therein without an inner shaft 110. Camshaft 50' includes a radially extending feed path 112' that extends between the inner passage 102 and an outer bushing 120' located around camshaft 50'. Outer bushing 120' includes two radially opening through slots 114*a*', 114*b*' spaced at a predefined interval around outer bushing 120'. The through slots 114*a*', 114*b*' extend through outer bushing 120' and open at an annular outer circumferential groove 126 of outer bushing 120' to provide fluid flow to flow paths 104, 106 when the feed path 112' aligns with one of the through slots 114*a*', 114*b*' at certain crank angle windows during a CDA mode of operation.

Figure 5:
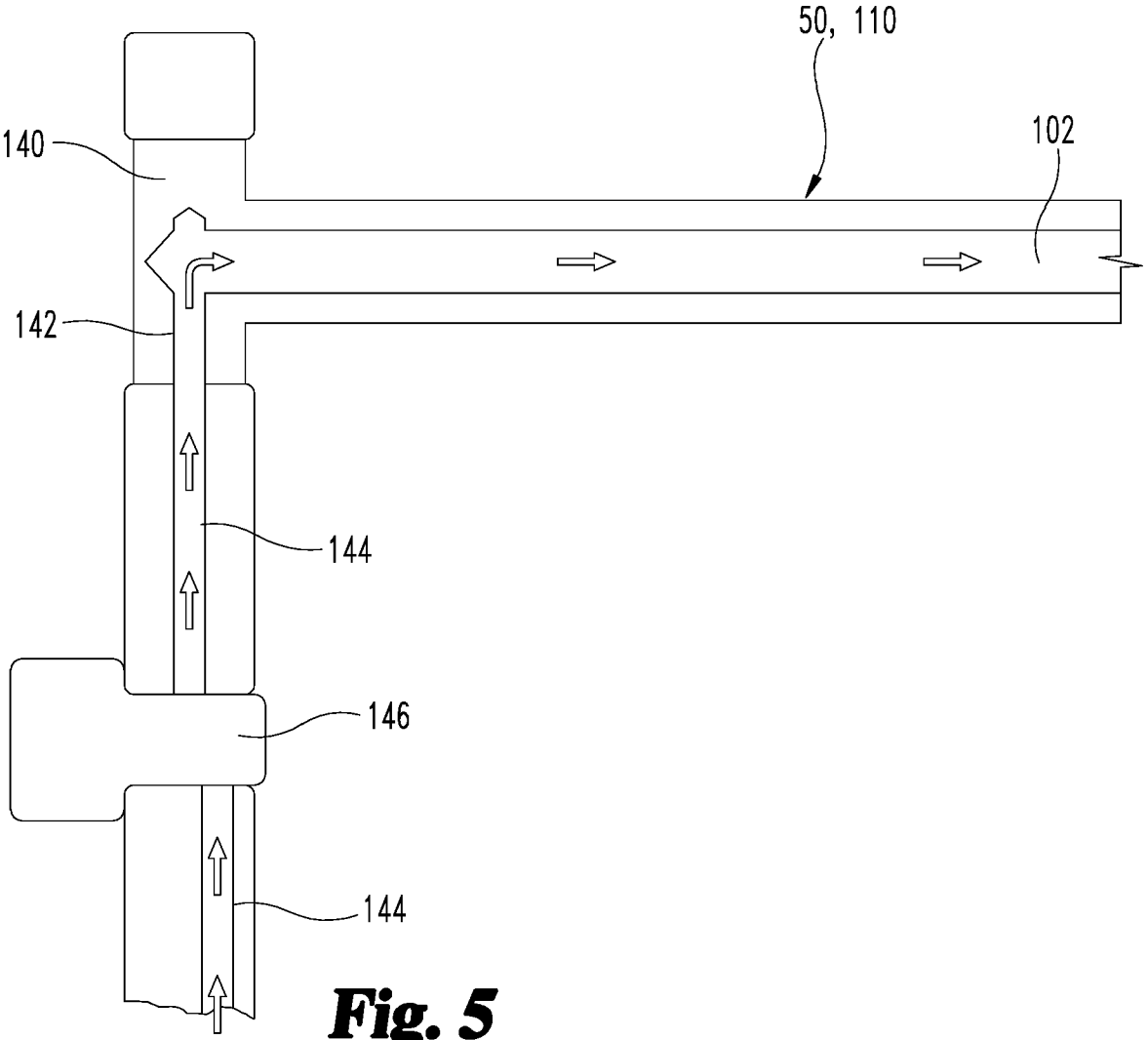
FIG. 5 is a schematic of one embodiment of a fluid supply for a cylinder deactivation system.

Referring to FIG. 5, one possible arrangement for providing fluid to inner passage is depicted. Inner passage 102 is provided in camshaft 50 or by an inner shaft 110, as discussed above. A shaft journal 140 is provided at one end of the camshaft 50 or inner shaft 110 that includes a fluid inlet 142. The head or cylinder block 108 includes rifling 144 that is supplied with fluid, such as oil, from the lubrication system of the engine 12. A flow control device 146, such as a valve, is provided in rifling 144 that can be opened and closed to selectively provide fluid to inner passage 102 for pressurization to activate and deactivate the CDA system(s) 70. As can be seen from FIG. 5, a single source of fluid can be employed to supply fluid for pressurization to deactivation the various cylinders 18 connected to inner passage 102, and therefore the CDA mode of operation can be controlled by a single solenoid for multiple CDA systems 70 rather than via separate solenoids for each CDA system 70.

Figure 6:
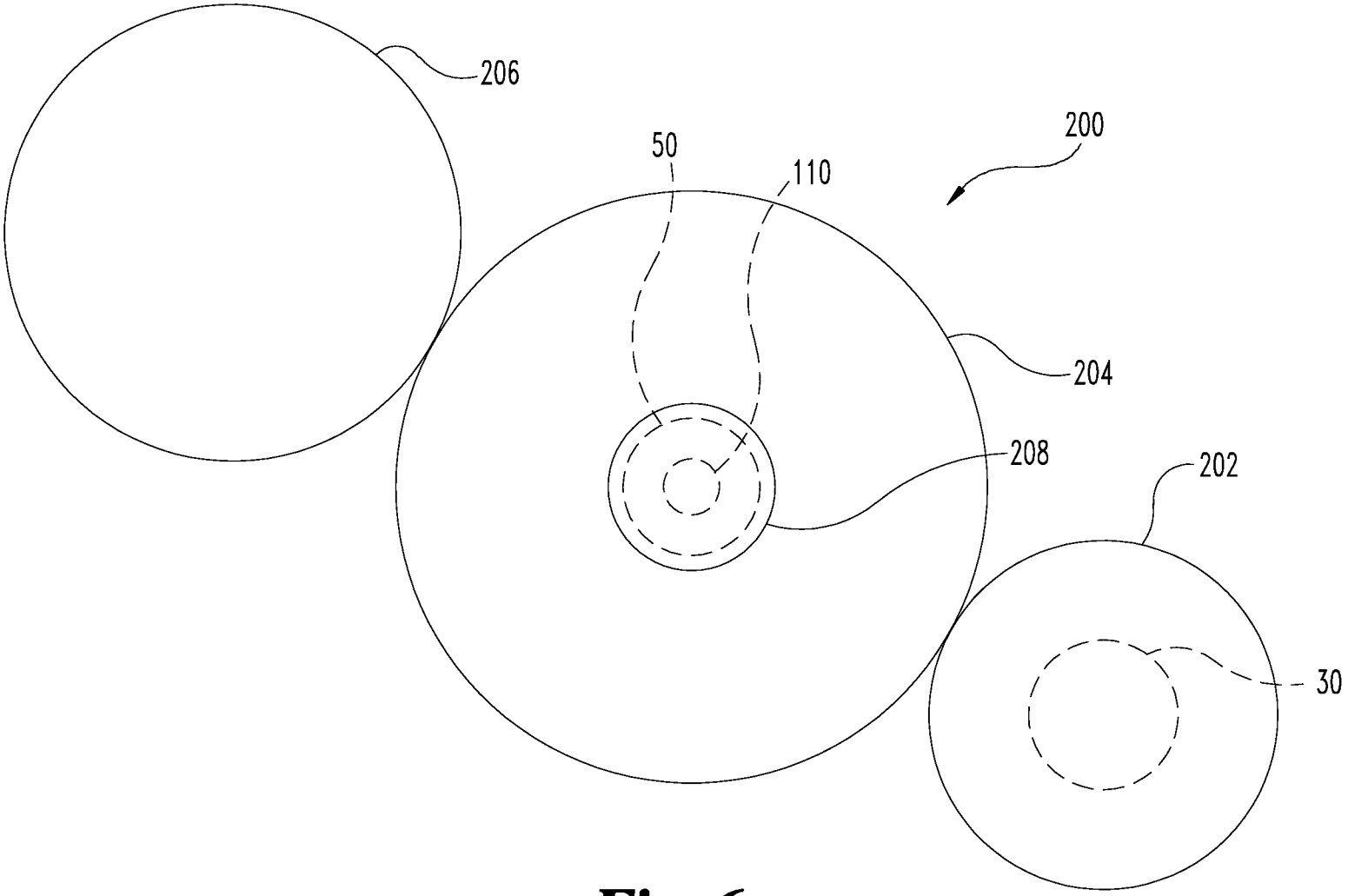
FIG. 6 is a schematic of one embodiment gear train for the cylinder deactivation system.

Referring to FIG. 6, one type of geartrain 200 is shown that can be used to rotate inner shaft 110 and camshaft 50. Geartrain 200 includes a crank gear 202 connected to crankshaft 30, a cam gear 204 connected to camshaft 50, and a drive gear 206 connected to inner shaft 110. Cam gear 204 can be connected to crank gear 202 at a 2:1 drive ratio so the camshaft 50 rotates at half the speed of crankshaft 30. Drive gear 206 can be connected to crank gear 202 through a compound idler gear 208 at a lower drive ratio, such as 4:1 or 8:1, to rotate at a quarter or eighth speed of the crankshaft 30.

Figure 7:
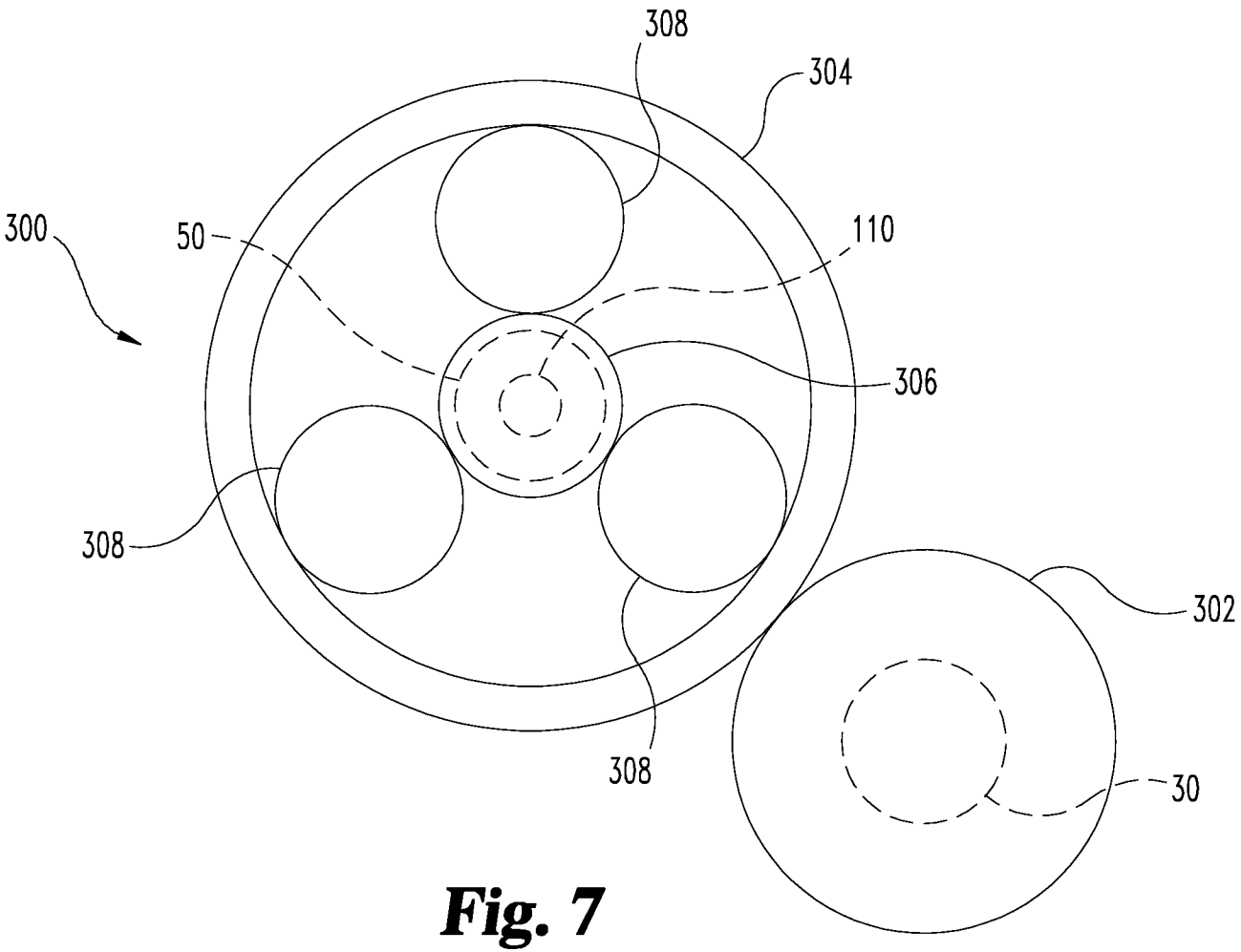
FIG. 7 is a schematic of another embodiment gear train for the cylinder deactivation system.

Referring to FIG. 7, another type of geartrain 300 is shown that can be used to rotate inner shaft 110 and camshaft 50. Geartrain 300 includes a crank gear 302 connected to crankshaft 30, a ring gear 304 connected to camshaft 50, and a drive gear 306 connected to inner shaft 110. Ring gear 304 can be connected to crank gear 302 at a 2:1 drive ratio so the camshaft 50 rotates at half the speed of crankshaft 30. Drive gear 306 can be connected to crank gear 202 through a number of planetary gears 308 at a lower drive ratio, such as 4:1 or 8:1, to rotate at a quarter or eighth speed of the crankshaft 30.

For embodiments without inner shaft 110, the camshaft 50 can be geared to the crankshaft 30 at a lower drive ratio, such as 4:1, to provide the desired CDA timing. In such an arrangement, an extra cam lobe may be required for each exhaust valve cam on the camshaft to provide the required exhaust valve opening timing during non-CDA operation.

In operation, the CDA system 70 can be employed to deactivate different sets of cylinders 18 of engine 12 for rolling, dynamic deactivation. For example, cylinders 18 are identified in FIG. 1 with numbers 1 through 6. In a geartrain arrangement in which inner shaft 110 rotates at a quarter speed of the crankshaft 30, then during one engine cycle (2 revolutions of crankshaft 30), one set of cylinders 18, such as cylinders #2 and #5, is deactivated. On the next engine cycle (2 more revolutions of crankshaft 30) another set of cylinders, such as cylinders #1 and #4, is deactivated. After 4 revolutions of the crankshaft 30, inner shaft 110 is back to its initial position and, if the deactivation mode is still active, cylinders #2 and #5 are deactivated on the next cycle.

In another embodiment, deactivation can alternate between 3 cylinder firing and 2 cylinder firing to avoid resonance issues. For example, with respect to engine 12 and a quarter speed gear reduction between the inner shaft 110 and crankshaft 30, during the first cycle, cylinder #1 and #3 can deactivate in the first revolution of crankshaft 30, and cylinder #4 can deactivate in the second revolution of crankshaft 30. In the second cycle, cylinder #5 deactivates in the third revolution of crankshaft 30 and cylinder #2 deactivates in the fourth revolution of crankshaft 30. Cycles 1 and 2 would then repeat when in a CDA mode of operation In yet another embodiment, inner shaft 110 does not rotate relative to camshaft 50 to align the feed path 112 with the fluid supply passages. Rather, a reciprocating, translating motion is provided to inner shaft 110 by the gear train, such as via a crank-slider mechanism. The reciprocating motion can be used to align fluid feed holes of the inner shaft with a flow path to the CDA system 70.

Various aspects of the present disclosure are contemplated. For example, according to one aspect, a system, includes an internal combustion engine including a crankshaft and a camshaft operably connected to the crankshaft at a first drive ratio. The camshaft is operably connected to a plurality of valve opening and closing mechanisms associated with a plurality of cylinders of the internal combustion engine. One or more of the plurality of cylinders is configured to be deactivated via the at least one of the plurality of valve opening mechanisms. The system also includes an inner passage within the camshaft that includes a pressurizable fluid in flow communication with the at least one of the plurality of valve opening mechanisms for selectively deactivating one or more of the plurality of cylinders.

In one embodiment, the system includes an inner shaft housed in the camshaft, and the inner passage is located in the inner shaft. In one embodiment, the inner shaft is operably connected to the crankshaft at a second drive ratio that is lower than the first drive ratio. In one embodiment, the camshaft and the inner shaft are connected to the crankshaft via a compound gear train. In one embodiment, the camshaft and the inner shaft are connected to the crankshaft via a planetary gear train.

In one embodiment, the system includes an inner bushing between the inner shaft and the camshaft and an outer bushing around the camshaft. The inner shaft includes a radially extending feed path extending from the inner passage to feed fluid from the inner passage to one or more through slots of the inner bushing. The one or more through slots of the inner bushing communicate with one or more transfer holes in the camshaft to provide the fluid from the inner passage to an annular groove of the outer bushing that is in fluid communication with the one or more transfer holes and with the at least one of the plurality of valve opening mechanisms.

In one embodiment, the one or more through slots includes at least two through slots that are spaced from one another around the inner bushing. A first one of the at least two through slots is associated with valve opening mechanisms for at least one of the plurality of cylinders for selectively deactivating the at least one of the plurality of cylinders in response to the first through slot aligning with the feed path and a second one of the at least two through slots is associated with valve opening mechanisms for at least a second one of the plurality of cylinders in response to the second through slot aligning with the feed path.

In one embodiment, the system includes an outer bushing around the camshaft and a radially extending feed path extending from the inner passage to feed fluid from the inner passage to one or more through slots of the outer bushing. The one or more through slots of the outer bushing provide the fluid from the inner passage to an annular groove of the outer bushing that is in fluid communication with the at least one of the plurality of valve opening mechanisms.

In one embodiment, the one or more through slots includes at least two through slots that are spaced from one another around the outer bushing. A first one of the at least two through slots is associated with valve opening mechanisms for at least one of the plurality of cylinders for selectively deactivating the at least one of the plurality of cylinders in response to the first through slot aligning with the feed path and a second one of the at least two slots is associated with valve opening mechanisms for at least a second one of the pair of the plurality of cylinders in response to the second through slot aligning with the feed path.

In an embodiment, at least one of the plurality of valve opening mechanisms includes a tappet.

According to another aspect of the present disclosure, an apparatus includes a camshaft for an internal combustion engine and an inner passage within the camshaft that includes a pressurizable fluid. The camshaft includes at least one radially extending feed path in fluid communication with the inner passage for providing pressurized fluid to at least one valve opening mechanism of the internal combustion engine in response to a cylinder deactivation event.

In one embodiment, the apparatus includes an inner shaft housed in the camshaft and the inner passage is located in the inner shaft.

In one embodiment, the apparatus includes an inner bushing between the inner shaft and the camshaft and an outer bushing around the camshaft. The inner shaft includes a radially extending feed path extending from the inner passage to feed fluid from the inner passage to one or more through slots of the inner bushing. The one or more through slots of the inner bushing communicate with one or more transfer holes in the camshaft to provide the fluid from the inner passage to an annular groove of the outer bushing that is in fluid communication with the one or more transfer holes and with the at least one valve opening mechanisms. In an embodiment, the one or more through slots includes at least two through slots that are spaced from one another around the inner bushing.

In one embodiment, the apparatus includes an outer bushing around the camshaft and a radially extending feed path extending from the inner passage to feed fluid from the inner passage to one or more through slots of the outer bushing. The one or more through slots of the outer bushing provide the fluid from the inner passage to an annular groove of the outer bushing that is in fluid communication with the at least one valve opening mechanisms. In an embodiment, the one or more through slots includes at least two through slots that are spaced from one another around the outer bushing.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine including a crankshaft;

a camshaft operably connected to the crankshaft at a first drive ratio, the camshaft further operably connected to a plurality of valve opening and closing mechanisms associated with a plurality of cylinders of the internal combustion engine, wherein one or more of the plurality of cylinders is configured to be deactivated via the at least one of the plurality of valve opening mechanisms;

an inner passage within the camshaft that includes a pressurizable fluid in flow communication with the at least one of the plurality of valve opening mechanisms for selectively deactivating one or more of the plurality of cylinders; and an outer bushing around the camshaft and a radially extending feed path extending from the inner passage to feed fluid from the inner passage to one or more through slots of the outer bushing, and wherein the one or more through slots of the outer bushing provide the fluid from the inner passage to an annular groove of the outer bushing that is in fluid communication with the at least one of the plurality of valve opening mechanisms.

2. The system of claim 1, further comprising an inner shaft housed in the camshaft, wherein the inner passage is located in the inner shaft.

3. The system of claim 2, wherein the inner shaft is operably connected to the crankshaft at a second drive ratio that is lower than the first drive ratio.

4. The system of claim 3, wherein the camshaft and the inner shaft are connected to the crankshaft via a compound gear train.

5. The system of claim 3, wherein the camshaft and the inner shaft are connected to the crankshaft via a planetary gear train.

6. The system of claim 2, further comprising an inner bushing between the inner shaft and the camshaft and an outer bushing around the camshaft, and wherein the inner shaft includes a radially extending feed path extending from the inner passage to feed fluid from the inner passage to one or more through slots of the inner bushing, and wherein the one or more through slots of the inner bushing communicate with one or more transfer holes in the camshaft to provide the fluid from the inner passage to an annular groove of the outer bushing that is in fluid communication with the one or more transfer holes and with the at least one of the plurality of valve opening mechanisms.

7. The system of claim 6, wherein the one or more through slots includes at least two through slots that are spaced from one another around the inner bushing, wherein a first one of the at least two through slots is associated with valve opening mechanisms for at least one of the plurality of cylinders for selectively deactivating the at least one of the plurality of cylinders in response to the first through slot aligning with the feed path and a second one of the at least two through slots is associated with valve opening mechanisms for at least a second one of the plurality of cylinders in response to the second through slot aligning with the feed path.

8. The system of claim 1, wherein the one or more through slots includes at least two through slots that are spaced from one another around the outer bushing, wherein a first one of the at least two through slots is associated with valve opening mechanisms for at least one of the plurality of cylinders for selectively deactivating the at least one of the plurality of cylinders in response to the first through slot aligning with the feed path and a second one of the at least two slots is associated with valve opening mechanisms for at least a second one of the pair of the plurality of cylinders in response to the second through slot aligning with the feed path.

9. The system of claim 1, wherein the at least one of the plurality of valve opening mechanisms includes a tappet.

10. The system of claim 1, wherein the at least one of the plurality of valve opening mechanisms includes a hydraulically activated cylinder deactivation system.

11. The system of claim 1, wherein the first drive ratio is 2:1.

12. An apparatus, comprising:

a camshaft for an internal combustion engine and an inner passage within the camshaft that includes a pressurizable fluid, wherein the camshaft includes at least one radially extending feed path in fluid communication with the inner passage for providing pressurized fluid to at least one valve opening mechanism of the internal combustion engine in response to a cylinder deactivation event;

an inner shaft housed in the camshaft, wherein the inner passage is located in the inner shaft; and an inner bushing between the inner shaft and the camshaft and an outer bushing around the camshaft, and wherein the inner shaft includes a radially extending feed path extending from the inner passage to feed fluid from the inner passage to one or more through slots of the inner bushing, and wherein the one or more through slots of the inner bushing communicate with one or more transfer holes in the camshaft to provide the fluid from the inner passage to an annular groove of the outer bushing that is in fluid communication with the one or more transfer holes and with the at least one valve opening mechanism.

13. The apparatus of claim 12, wherein the one or more through slots includes at least two through slots that are spaced from one another around the inner bushing.

14. An apparatus, comprising:

a camshaft for an internal combustion engine and an inner passage within the camshaft that includes a pressurizable fluid, wherein the camshaft includes at least one radially extending feed path in fluid communication with the inner passage for providing pressurized fluid to at least one valve opening mechanism of the internal combustion engine in response to a cylinder deactivation event; and an outer bushing around the camshaft and a radially extending feed path extending from the inner passage to feed fluid from the inner passage to one or more through slots of the outer bushing, and wherein the one or more through slots of the outer bushing provide the fluid from the inner passage to an annular groove of the outer bushing that is in fluid communication with the at least one valve opening mechanism.

15. The apparatus of claim 14, wherein the one or more through slots includes at least two through slots that are spaced from one another around the outer bushing.

16. The apparatus of claim 14, wherein the camshaft is geared to a crankshaft at a drive ratio of 4:1.

* * * * *